US009389053B2

(12) United States Patent
Willhelm et al.

(10) Patent No.: US 9,389,053 B2
(45) Date of Patent: Jul. 12, 2016

(54) 40MM DOOR-BREACHING GRENADE

(71) Applicants: Robert Willhelm, Mesa, AZ (US); John Johnson, Mesa, AZ (US); Wayne Mayville, Phoenix, AZ (US); Glade Hansen, Queen Creek, AZ (US); Andrew Richard Davis, Mesa, AZ (US); Chad Lewis Greenlee, Gilbert, AZ (US)

(72) Inventors: Robert Willhelm, Mesa, AZ (US); John Johnson, Mesa, AZ (US); Wayne Mayville, Phoenix, AZ (US); Glade Hansen, Queen Creek, AZ (US); Andrew Richard Davis, Mesa, AZ (US); Chad Lewis Greenlee, Gilbert, AZ (US)

(73) Assignee: Nammo Talley, Inc., Messa, AZ (US)

( * ) Notice: Subject to any disclaimer, the term of this patent is extended or adjusted under 35 U.S.C. 154(b) by 0 days.

(21) Appl. No.: 14/173,443

(22) Filed: Feb. 5, 2014

(65) Prior Publication Data

US 2014/0331884 A1 Nov. 13, 2014

Related U.S. Application Data

(60) Provisional application No. 61/760,908, filed on Feb. 5, 2013.

(51) Int. Cl.

| | |
|---|---|
| ***F42B 12/04*** | (2006.01) |
| ***F42B 12/20*** | (2006.01) |
| ***F42B 33/00*** | (2006.01) |
| ***F42B 33/02*** | (2006.01) |
| ***F42C 1/02*** | (2006.01) |
| *F42C 13/00* | (2006.01) |
| *F42B 33/04* | (2006.01) |

(52) U.S. Cl.

CPC ..... *F42B 12/204* (2013.01); *F42B 33/001* (2013.01); *F42B 33/0214* (2013.01); *F42C 1/02* (2013.01); *F42B 12/207* (2013.01); *F42B 33/04* (2013.01); *F42C 13/00* (2013.01)

(58) Field of Classification Search

CPC ..... F42B 30/04; F42B 5/02; F42B 14/02; F42B 12/204; F42B 12/207; F42B 12/20

USPC ..... 102/482, 306, 439, 447, 475, 483, 487, 102/488, 492, 498, 506, 211, 481, 233, 265, 102/489, 208, 273, 207; 89/6.5, 1.14; 86/25, 31, 51, 53; 42/105

See application file for complete search history.

(56) References Cited

U.S. PATENT DOCUMENTS 3,877,378 A * 4/1975 Clark ..... F42C 9/148 102/207

4,002,123 A * 1/1977 Fisher ..... F42C 15/295 102/208

(Continued)

*Primary Examiner* — Samir Abdosh
*Assistant Examiner* — John D Cooper
(74) *Attorney, Agent, or Firm* — Kenyon & Kenyon LLP

(57) ABSTRACT

The invention provides a short-range, self-propelled, non-fragmenting breaching device to breach a wide variety of doors and barricades with high efficiency, high gunner safety and low collateral damage. The invention also provides a method of preparing the breaching device and a method of breaching a target using the breaching device.

18 Claims, 1 Drawing Sheet

(56) References Cited

U.S. PATENT DOCUMENTS 4,991,508 A * 2/1991 Ziemba ..... F42C 13/04 102/211
5,081,929 A * 1/1992 Mertens ..... F42C 1/06 102/246
5,585,592 A * 12/1996 Stearns ..... F42C 15/18 102/211
5,883,328 A 3/1999 A'Costa
6,048,379 A * 4/2000 Bray ..... C08K 3/08 102/517
6,179,944 B1 1/2001 Monolo et al.
6,408,765 B1 6/2002 Tauber et al.
7,000,545 B2 2/2006 Sansolo
8,297,190 B1 * 10/2012 Dindl ..... F42B 5/145 102/430
2003/0226467 A1 * 12/2003 Nardone ..... F42B 12/58 102/489
2004/0237825 A1 * 12/2004 Ronn ..... F42C 13/023 102/211
2006/0087472 A1 * 4/2006 Troutman ..... F42C 11/008 342/68
2011/0174187 A1 7/2011 Van Stratum
2012/0216698 A1 * 8/2012 Van Stratum ..... F42B 30/04 102/439
2013/0199395 A1 * 8/2013 Frew ..... F42B 12/207 102/481

* cited by examiner

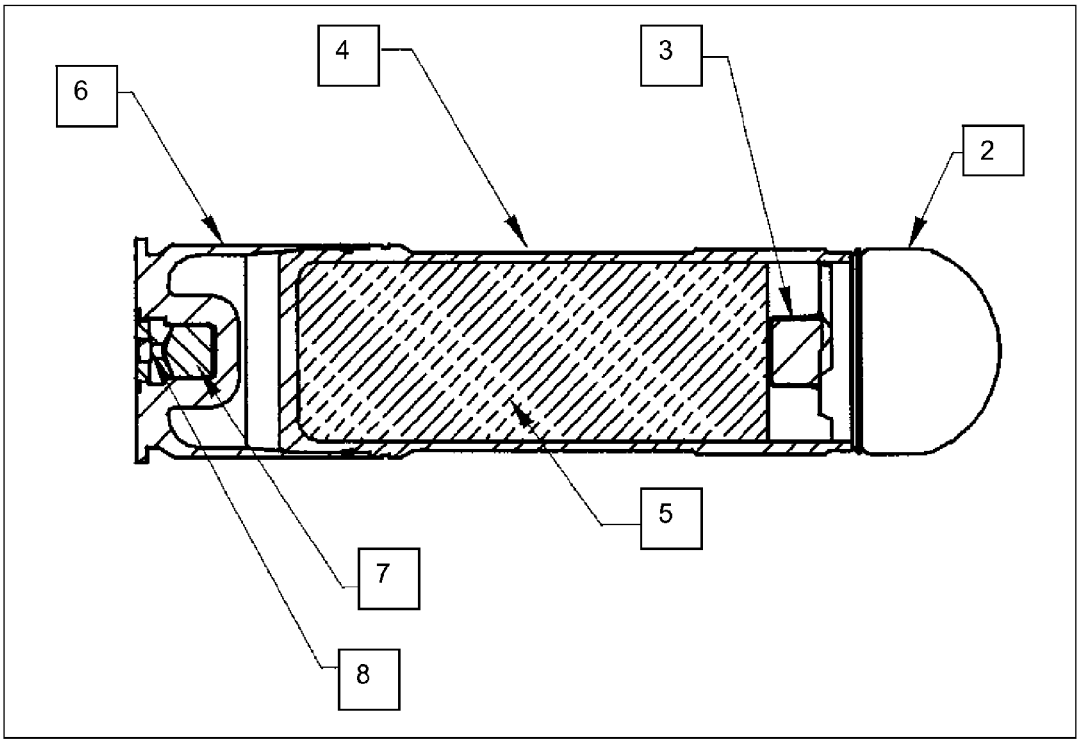
1

40MM DOOR-BREACHING GRENADE

RELATED APPLICATION

This invention claims benefit of U.S. Provisional Patent Application No. 61,760,908, filed Feb. 5, 2013, the contents of which are incorporated herein in their entirety by reference.

FIELD OF THE INVENTION

The present invention relates to the use of a short-range, self-propelled, non-fragmenting 40 mm grenade fired from a low-velocity launcher for breaching doors and other barricades for military and law enforcement.

BACKGROUND OF THE INVENTION

Low-velocity, launcher-fired 40 mm grenades or rounds are known in the art. Standard issue 40 mm grenades, such as the M-433 with its shaped charge and fragmenting body or case, are designed to defeat light armor and personnel. The M-433 grenade is designed for maximum fragmentation and is therefore unacceptable for breaching doors and other barricades due to the high probability of collateral damage and gunner injury. A detailed discussion of the propulsion system of the M-433 and a typical fuzeH assembly, the M-550 point-initiating, base-detonating fuze, is beyond the scope of this disclosure. The reader is referred to U.S. Pat. No. 5,081,929 to Mertens (1992), which is hereby expressly incorporated by reference.

With war fighting moving to urban environments, these 40 mm grenades are being fired at shorter distances and are being used to breach doors and other barricades, but with little effectiveness due to the small amount of explosive in the ammunition. These rounds of ammunition, when fired at short distances also pose danger to the user due to the fragmenting bodies or "fragments." As used herein, the term "non-fragmenting" grenade refers to a round that minimizes or greatly reduces the hazardous fragments of shrapnel upon explosion.

These standard low-velocity, launcher-fired 40 mm grenades generally have explosive loads of less than 50 grams. Although other manufacturers have attempted to improve these 40 mm grenades, their explosive loads are usually less than 50 grams and they may not be effective on a wide variety of doors. Additionally, some 40 mm grenades with higher explosive loads still have fragmenting bodies that pose danger to the user. During the breaching of a door, fragmentation is a serious danger to the user and to bystanders.

The 40 mm Hellhound by Martin Electronics Incorporated (MEI) is another widely used low-velocity grenade designed to be fired from a 40 mm grenade launcher. The Hellhound has been designed to have a fragmentation radius that is twice that of the standard M-433 grenade. This increases the risk to the gunner and the probability of collateral damage, making the Hellhound not practical for the breaching of doors and barricades and more lethal than ordinary 40 mm grenades.

The HE/DB07 40×46 mm door-breacher, available from American Rheinmetall Munitions, Inc., is another low-velocity grenade designed for breaching doors. The DB07 round differs from conventional high explosive (HE) grenades in that it is designed to enhance blast but reduce fragmentation. However, this round has two significant disadvantages when used for defeating doors and barricades. First, the explosive charge is undersized and has difficulty defeating the wide variety of doors in the target set. Second, the fuze is at the rear of the explosive charge so that when the round detonates the fuze fragments are sent back toward the gunner, greatly increasing his risk of injury.

The previous grenade designs pose a risk of injury to the gunner due to shrapnel and may not generate the overpressure required to defeat a door or barricade.

U.S. Pat. No. 6,408,765 reports a door-breaching device with a safety adaptor for controlled blasting of an object at short range using a gun-launched system. The blasting element in the device includes an explosive charge contained within a housing; the blasting element blasts the object from a preset distance. A stand-off rod with a length equal to the preset distance is connected to the housing. A pyrotechnic lead pellet is reported to detonate the explosive charge upon impact of the stand-off rod with the object. The tail, connected to the blasting element through a safety connector, reportedly reduces shock forces acting on the tail resulting from detonation of the explosive charge and reduces the risk of tail or any other parts being propelled rearwards causing injury to the operator or other bystanders.

U.S. Patent Publication Nos. 2011/0174187 and 2012/0216698 report a door-breaching projectile system using a modified 40 mm grenade round designed to breach doors without throwing a substantial amount of shrapnel into a building's interior. The modified round has a standoff device located on its forward end, which detonates the explosive charge within the projectile before the nose of the projectile strikes the target. This early detonation throws a pressure wave again the door's exterior, forcing the door inward. Shrapnel produced by the detonation remains primarily outside the door. Thus, the projectile is reportedly able to blow open a door without throwing a significant amount of shrapnel into a building's interior.

U.S. Pat. No. 7,000,545 reports a multifunctional breaching apparatus for gaining entry by explosive forces using a hand-placed system. The reference states that the breaching apparatus has a housing made of a flexible polymeric material that disintegrates upon explosion, without significant fragmentation. An explosive element in the housing is reported to be capable of producing sufficient explosive force to breach a structure. The breaching apparatus has a flexible detonating cord or explosive wire wound or wrapped around partitions encased in the housing. A detonator device is placed in line with the detonator cord to initiate the explosive force. The housing is mounted or affixed to any structure (e.g., doors or buildings) by various attachment devices or is attached to a robotic arm, for safe remote operation. The structure is reported to help prolong the time duration of the pushing force of the breaching apparatus while simultaneously producing a controlled explosive force to breach a door (without fragmentizing the door) and free locking bolts from their moorings, without harming the rest of the building or nearby structures or buildings. The breaching apparatus contains hollow chambers holding detonators and positioned close to the housing surface attached to the structure to be breached (e.g., windows or shutters), so that most of the explosive force is directed towards the structure being breached.

U.S. Pat. No. 6,179,944 reports a process for preparing thin-walled, lightweight, non-fragmenting warhead composite casings for use as explosive warheads. The warhead casing is prepared from thermosetting epoxy resin and carbon fibers. The epoxy resin is a liquid, low viscosity resin at ambient temperatures, curable at temperatures ranging up to 175° F. and having a glass transition temperature Tg range from 200° F. to 250° F. The warhead casing is reported to be capable of losing its structural integrity at temperatures below the ignition temperature of the explosive in the casing, thus eliminating or minimizing the likelihood of undesirable explosive reactions caused by high temperatures.

U.S. Pat. No. 5,883,328 reports a tactical smoothbore breaching device for use with shotguns for breaching structures such as doors, windows and gates. The ammunition is loaded into the gun, aimed at the target and is discharged. The force of the projectile is reported to breach a door hinge or door lock and disintegrate while imparting the force to the target so that only a small amount of debris, primarily dust, enters the structure, while destroying the door, lock or gate with minimal blowback toward the shooter.

The known grenades currently produced are not effective against a wide variety of doors and barricades and do not overcome all of disadvantages of fragmentation, leading to personal injury and collateral damage, and insufficient explosive charge and overpressure required to defeat such doors or barricades. Methods for breaching a door using an explosive charge placed on the door, a shotgun round at point-blank range or a battering ram still expose personnel to risk of death or injury.

The new short-range, self-propelled, non-fragmenting door-breaching 40 mm grenade of the invention overcomes these shortcomings and may be used to breach a wide variety of doors and barricades with high efficiency, high gunner safety and low collateral damage. The present invention greatly reduces the risk to the operators allowing them to remain undercover and increases their safety during the door-breaching process.

SUMMARY OF THE INVENTION

The present invention is directed to a short-range, self-propelled, non-fragmenting breaching device comprising a high-density, composite housing containing an explosive charge that is greater than about 50 grams, a nose fuze assembly comprising a detonator disposed to initiate the explosive charge that arms in less than about 10 meters, and a cartridge case assembly comprising a propelling charge and a primer disposed to ignite the propelling charge.

The nose fuze assembly in the breaching device is point-initiating. The explosive charge composition is selected from a family of insensitive explosive fills, manufactured by Nammo Talley. Insensitive explosive fills are generally less sensitive to many physical effects that can trigger unwanted explosions and were developed to improve munitions survivability and safety, by being capable of withstanding accidents, fires, or enemy attack. As used herein, the term "insensitive explosive fills" refers to the following non-limiting examples: mixtures of 2,4,6-trinitrotoluene (TNT) and aluminum; propellant-like, plastic-bonded explosives such as AFX-757 (PBX) used in the Joint Air-to-Surface Stand-off Missile; dinitroimidazoles, including 2,4-dinitroimidazoles (DNI) and 4,5-dinitroimidazoles (45DNI); 1,3,5-triamino-2,4,6-trinitrobenzene (TATB)-based formulations such as Livermores's LX-17 and Los Alamos's PBX 9502; melt castable, wax binder explosive fills such as MNX-194, which replaces TNT in Army M107/M795 155 mm artillery rounds; Picatinny Arsenal Explosive (PAX) formulations including combinations of energetic fill binders and plasticizers; PBXIH-135 thermobaric explosives; cast-cured polymer-bonded explosives; energetic composite formulations used in PBXN-109 and AFX-757 hard target penetrator warheads; RS-RDX Reduced Sensitivity RDX formulations; or 1,3,3-trinitroazetidine (TNAZ) explosives.

In an embodiment, the weight of the explosive charge in the breaching device is preferably in a range of about 50 grams to about 300 grams, more preferably, about 50 grams to about 150 grams.

In an embodiment, the weight of the explosive charge in the breaching device is about 150 grams for breaching heavy doors and other barricades.

In an embodiment, a proximity sensing fuze may be optionally integrated into the breaching device.

The breaching device may be used as a close-quarter offensive grenade with minimum fragments to reduce collateral damage.

The invention also comprises a method of preparing a breaching device comprising the steps of filling a housing with an explosive charge; assembling the cartridge case assembly to the aft end of the housing; and assembling a nose fuze assembly to the forward end of the housing. The housing, which may comprise a high-density, composite, contains an explosive charge greater than about 50 grams. The nose fuze assembly comprises a detonator disposed to initiate the explosive charge that arms in less than about 10 meters. The cartridge case assembly comprises a propelling charge and a primer disposed to ignite the propelling charge.

In another embodiment, a method of breaching a target using a breaching device fired from a weapon launcher comprises the steps of loading and launching the breaching device to breach the target of doors and other barricades.

The present invention is also directed to a short-range, self-propelled, non-fragmenting, door-breaching 40 mm grenade comprising a high-density, composite housing containing an explosive charge greater than about 50 grams; a nose fuze assembly comprising a detonator disposed to initiate the explosive charge that arms in less than about 10 meters, and a cartridge case assembly comprising a propelling charge and a primer disposed to ignite the propelling charge. The nose fuze assembly of the 40 mm grenade is point-initiating. The explosive charge composition may be selected from a family of insensitive explosive fills.

In an embodiment, the weight of the explosive charge in the 40 mm grenade is preferably in a range of about 50 grams to about 300 grams, more preferably in a range of about 50 grams to about 150 grams.

In another embodiment, the weight of the explosive charge in the 40 mm grenade is about 150 grams, for breaching heavy doors and other barricades.

A proximity sensing fuze may be optionally integrated into the 40 mm grenade.

In an embodiment, the 40 mm grenade is used as a close-quarter offensive grenade with minimum fragments to reduce collateral damage.

The invention also provides a method of preparing the 40 mm grenade comprising the steps of filling a housing with an explosive charge; assembling the cartridge case assembly to the aft end of the housing; and assembling a nose fuze assembly to the forward end of the housing. The high-density, composite housing contains an explosive charge greater than about 50 grams. The nose fuze assembly comprises a detonator disposed to initiate the explosive charge that arms in less than about 10 meters. The cartridge case assembly comprises a propelling charge and a primer disposed to ignite the propelling charge.

In another embodiment, a method of breaching a target using the 40 mm grenade, fired from a low-velocity, 40 mm grenade launcher comprises the steps of loading and launching the grenade to breach the target of doors and other barricades.

BRIEF DESCRIPTION OF THE DRAWINGS

FIG 1 is a cross-sectional view of the 40×46 mm door-breaching grenade of the invention.

DETAILED DESCRIPTION OF THE PREFERRED EMBODIMENTS

The nose fuze assembly of the 40 mm grenade is point-initiating, and is mounted in the forward position to increase gunner safety by reducing rearward traveling metal fragments. The primer detonates the explosive charge substantially upon impact of the fuze assembly with the target.

Current fuzing mechanisms are point-detonating, or "nose fuzes" because of their location in the projectile, and concentrate the explosive energy on a small area of the door. This can cause holes and tearing of the door. A proximity sensing fuze is optionally integrated into the round to more effectively breach the door. Proximity fuzes or variable time (VT) fuzes operate through "influence sensing," with no contact between the warhead and target. These fuzes are actuated by some characteristic feature of the target rather than physical contact with it. The action causes the fuze to detonate before impact when any substantial object is detected at a predetermined distance from the fuze. Initiation can be caused by a reflected radio signal, an induced magnetic field, a pressure measurement, an acoustical impulse or an infrared signal.

The weight of the explosive charge is preferably in a range of about 50 grams to about 300 grams. In one embodiment of the invention, a 150 gram explosive charge is optimized for breaching heavy doors and barricades. In an embodiment, an explosive-filled 40 mm grenade can be loaded to more than 80-150 grams of explosive for use against heavy doors and barricades, preferably 110-120 grams.

The target is preferably selected from the group consisting of a door, window, gate and other barricades. The short-range, self-propelled, non-fragmenting 40 mm door-breaching grenade is designed to optimize effectiveness and gunner safety and limit collateral damage. Short range as used herein means 15 to 100 meters. The expected effective range of the grenade is preferably 10 meters to 50 meters, and more preferably less than 10 meters, to allow rapid entry into the breached door or barricade.

In an embodiment of the invention, the door-breaching 40 mm grenade is used as a close-quarter offensive grenade. The shock waves (overpressure) produced by this grenade when used in enclosed areas neutralize threats without fragmentation thereby reducing collateral damage.

In an embodiment, the housing is comprised of a high-density composite, preferably a plastic compounded with a high-density metal powder. The high-density composite housing insures stable flight while reducing grenade body fragments. An advantage of composite grenades is that, unlike conventional grenades, they cause low collateral damage (no uncontrolled fragmentation). The behavior of the composite on impact is key to why fragments of the grenade are not propelled back to the shooter. Moreover, composites offer a combination of high strength, low weight and excellent heat resistance, making composite materials an advantageous choice for grenade components. Composite components are rugged, withstand tough handling and contribute to high precision and low collateral damage.

To achieve this invention, the 40 mm grenade is produced using any suitable assembly method known to one of skill in the art and includes the following nonlimiting examples: threads, glue, crimp, press, swage, or the like.

The invention provides a method of preparing a short-range, self-propelled, non-fragmenting door-breaching 40 mm grenade fired from a low-velocity 40 mm launcher for opening doors and other barricades, comprising the steps of (a) providing an injection-molding of the outer part of the grenade using a plastic, compounded with a high-density metal powder; (b) loading the grenade body with an explosive fill, which is vacuum-cast into the plastic grenade body in a remote operation (optionally, a pressed explosive composition or a melt explosive composition is used); (c) curing the explosive fill prior to additional assembly work; (d) assembling the propelling charge and primer into the cartridge case assembly and crimping into place; (e) pressing and crimping the loaded cartridge case assembly onto the aft end of the loaded grenade assembly, following completion of the grenade cure, and (f) bonding a fuze assembly onto the forward end of a loaded grenade assembly to provide the completed door-breaching grenade.

The invention presents advantages of increased gunner safety, reduced collateral damage and reduction of hazardous rearward fragments by use of a forward-mounted nose fuze assembly and a high-density composite housing. The nose fuze is a fast-arming fuze, which arms in less than about 10 meters, and is used to reduce standoff distance thereby facilitating a faster entry of the breached door or barricade.

The principles and operation of a grenade according to the present invention may be better understood with reference to the drawings and the accompanying description.

Reference is now made to FIG 1, which illustrates a short-range, self-propelled, non-fragmenting, door-breaching 40 mm grenade 1, constructed and operative in accordance with an embodiment of the present invention, for controlled blasting of a grenade at short range. The forward end of the door-breaching 40 mm grenade 1 preferably comprises a nose fuze assembly 2, that allows a high-density composite housing 4, containing an explosive charge 5 to enter the target. The nose fuze assembly 2 preferably allows the grenade 1 to explode on penetration of a target, such as a door. The nose fuze assembly 1 is point-initiating, detonating the forward end of the grenade. An additional measure used to reduce rearward traveling fragments is placement of the nose fuze assembly 2 at the front of the grenade 1 to prevent individual parts of the nose fuze assembly 2 from being blown back toward the user. By placing the nose fuze assembly in the nose of the grenade 1, most of the explosive force is directed towards the structure being breached. A proximity sensing fuze is optionally integrated into the round to more effectively breach the door.

The cartridge is a dual purpose impact type round, which is designed to open a hollow core internally strengthened door made of at least 14 gauge steel at 0° angle of obliquity without inflicting personnel casualties to the gunner.

In order to reduce the fragmentation danger, the short-range, self-propelled, non-fragmenting, door-breaching 40 mm grenade 1 comprises a high-density composite housing 4, disposed behind the detonator 3. The housing 4 contains an explosive charge 5. This grenade is the only launcher-fired 40 mm grenade with an explosive weight greater than 50 grams that is effective for breaching doors and limiting the fragmentation hazard to the user. Because of the reduced fragmentation from this grenade, a fast-arming fuze, which arms in less than 10 meters is used to reduce standoff distance, thereby facilitating a faster entry of the breached door or barricade.

Explosive charge 5 is comprised of a cast insensitive explosive, produced at Nammo Talley. The explosive charge 5 disposed in high-density composite housing 4 is capable of producing an explosive force sufficient for breaching a door.

The aft or tail end of the grenade 1 houses a standard 40×46 mm cartridge case assembly 6, disposed behind the plastic housing 4, contains a propelling charge 7 and a primer 8. The cartridge case is preferably constructed of aluminum or plastic.

A safe and arm (S&A) system is incorporated into the fuze to allow for safe handling, transport and storage. One safety factor is the separation of the two explosive components in the grenade, the primer and a detonator at the base of the fuze assembly.

EXAMPLES

Testing

Extensive testing showed that the non-fragmenting, door-breaching 40 mm grenade is sufficient to open an inward opening 18 gauge, hollow core, internally braced door. Flight stability testing demonstrated that the rounds are stable in flight across the operating temperature range of −25° F. to 140° F.

The round is fired from a 40 mm grenade launcher against doors and barricades or as an offensive grenade. The expected minimum effective range of the round is 10 meters and the maximum effective range is estimated to be 100 meters.

What is claimed is:

1. A short-range, self-propelled, non-fragmenting breaching device comprising:

a high-density, composite housing;

a nose fuze assembly disposed at the forward end of the housing, wherein the nose fuze assembly includes a detonator;

a cartridge case assembly disposed at the aft end of the housing, wherein the cartridge case assembly includes a propelling charge and a primer to ignite the propelling charge; and an explosive charge disposed between the nose fuze assembly and the cartridge case assembly, wherein the explosive charge has a weight that is greater than 50 grams wherein the breaching device has a minimum effective range of 10 meters, wherein the nose fuze assembly is point-initiating, and wherein the detonator detonates the explosive charge upon impact of the nose fuze assembly with a target.

2. The breaching device according to claim 1, wherein the explosive charge composition comprises an a insensitive explosive.

3. The breaching device according to claim 1, wherein the weight of the explosive charge is in a range of 50 grams to about 300 grams.

4. The breaching device according to claim 3, wherein the weight of the explosive charge is in a range of 50 grams to 150 grams.

5. . The breaching device according to claim 4, wherein the weight of the explosive charge is 150 grams.

6. The breaching device according to claim 1, wherein the breaching device is a close-quarter offensive grenade with minimum fragments to reduce collateral damage.

7. The short-range, self-propelled, non-fragmenting breaching device of claim 1, wherein the composite housing contains a plastic compounded with a high density metal powder.

8. A method of preparing the breaching device of claim 1, the method comprising the steps of:

(a) filling a high-density, composite housing with an explosive charge;

(b) assembling a cartridge case assembly to the aft end of the housing; and (c) assembling a nose fuze assembly to the forward end of the housing.

9. A method of breaching a target using the breaching device of claim 1, the method comprising the steps of:

(a) loading the breaching device into a weapon launcher; and (b) launching the breaching device to breach a barricade target.

10. A short-range, self-propelled, non-fragmenting, door-breaching 40 mm grenade comprising:

a high-density, composite housing;

a nose fuze assembly disposed at the forward end of the housing, wherein the nose fuze assembly includes a detonator;

a cartridge case assembly disposed at the aft end of the housing, wherein the cartridge case assembly includes a propelling charge and a primer to ignite the propelling charge; and an explosive charge disposed between the nose fuze assembly and the cartridge case assembly, wherein the explosive charge has a weight that is greater than 50 grams;

wherein the breaching device has a minimum effective range of 10 meters wherein the nose fuze assembly is point-initiating, and wherein the detonator detonates the explosive charge upon impact of the nose fuze assembly with a target.

11. The 40 mm grenade according to claim 10, wherein the explosive charge composition comprises an a insensitive explosive.

12. The 40 mm grenade according to claim 10, wherein the weight of the explosive charge is in a range of 50 grams to 300 grams.

13. The 40 mm grenade according to claim 12, wherein the weight of the explosive charge is in a range of 50 grams to 150 grams.

14. The 40 mm grenade according to claim 13, wherein the weight of the explosive charge is 150 grams.

15. The 40 mm grenade according to claim 10, wherein the grenade is a close-quarter offensive grenade with minimum fragments to reduce collateral damage.

16. The short-range, self-propelled, non-fragmenting, door-breaching 40mm grenade of claim 10, wherein the composite housing contains a plastic compounded with a high density metal powder.

17. A method of preparing the 40 mm grenade of claim 10, the method comprising the steps of:

(a) filling a high-density, composite housing with an explosive charge;

(b) assembling a cartridge case assembly to the aft end of the housing; and (c) assembling a nose fuze assembly to the forward end of the housing.

18. A method of breaching a target using the 40 mm grenade of claim 10, the method comprising the steps:

(a) loading the 40 mm grenade into a low velocity, 40 mm grenade launcher; and (b) launching the 40 mm grenade to breach a barricade target.

* * * * *